US006670755B2

(12) United States Patent
Masuda et al.

(10) Patent No.: US 6,670,755 B2
(45) Date of Patent: Dec. 30, 2003

(54) PLASMA DISPLAY PANEL AND METHOD FOR MANUFACTURING THE SAME

(75) Inventors: Kohsuke Masuda, Yamanashi-ken (JP); Toshihiro Komaki, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 387 days.

(21) Appl. No.: 09/769,248

(22) Filed: Jan. 26, 2001

(65) Prior Publication Data

US 2001/0015622 A1 Aug. 23, 2001

(30) Foreign Application Priority Data

Jan. 31, 2000 (JP) ..... 2000-022072

(51) Int. Cl.[7] ..... H01J 17/49

(52) U.S. Cl. ..... 313/582; 313/586; 313/587; 313/610

(58) Field of Search ..... 313/582, 584, 313/586, 587, 604, 610

(56) References Cited

U.S. PATENT DOCUMENTS 5,818,168 A * 10/1998 Ushifusa et al. ..... 313/582
6,482,062 B1 * 11/2002 Yao et al. ..... 313/582

FOREIGN PATENT DOCUMENTS

JP 2000-243264 * 9/2000 ..... H01J/9/02
JP 2000-251696 * 9/2000 ..... H01J/9/02
JP 2000-251697 * 9/2000 ..... H01J/9/02

* cited by examiner

*Primary Examiner*—Harshad Patel
(74) *Attorney, Agent, or Firm*—Arent Fox Kintner Plotkin & Kahn, PLLC

(57) ABSTRACT

A plasma display panel comprises a front substrate plate; a back substrate plate arranged opposite to the front substrate plate with an electric discharge space formed therebetween; a plurality of partition walls dividing the discharge space into a plurality of discharge cells; and a plurality of fluorescent layers each covering the bottom and side surfaces of each discharge cell. In particular, each of the partition walls has a T-shaped cross section.

5 Claims, 4 Drawing Sheets

PLASMA DISPLAY PANEL AND METHOD FOR MANUFACTURING THE SAME

BACKGROUND OF THE INVENTION

The present invention relates to a plasma display panel (PDP) and a method for manufacturing the same. In particular, this invention relates to a plasma display panel having improved partition walls forming numerous discharge cells and a method for forming the partition walls.

FIG. 4 is a perspective view showing the structure of an AC-type plasma display panel. In the drawing, reference numeral 1 represents a front glass substrate whose front surface serves as a display surface. A plurality of row electrode pairs (X, Y) extending in row direction (L direction, i.e., display line direction) are provided on the inner surface of the front glass substrate 1. One row electrode X of each row electrode pair (X, Y) includes i) a belt-like transparent electrode Xa consisting of a transparent electrically conductive film (such as ITO) and extending in row direction, and ii) a bus electrode Xb similarly extending in row direction and connected with the edge portions of the transparent electrode Xa. Similarly, the other row electrode Y of each row electrode pair (X, Y) includes i) a belt-like transparent electrode Ya consisting of a transparent electrically conductive film (such as ITO) and extending in row direction, and ii) a bus electrode Yb similarly extending in row direction and connected with the edge portions of the transparent electrode Ya. In this way, a plurality of the row electrodes X and a plurality of the row electrodes Y are arranged alternatively in column direction (R direction), with each row electrode pair (X, Y) forming an electric discharge gap therebetween.

Further, as shown in FIG. 5, a dielectric layer 2 is also formed on the inner surface of the front glass substrate 1 to cover up the row electrode pairs (X, Y). Here, the dielectric layer 2 is formed by applying to the inner surface of the glass substrate I an amount of glass paste having a low melting point, thereby forming a glass paste layer having a predetermined thickness. The glass paste layer is then subjected to a drying treatment and further by a sintering treatment at a predetermined temperature, thus forming the desired dielectric layer 2. Moreover, a protection layer 3 consisting of MgO is formed to cover the dielectric layer 2.

Referring again to FIG. 4, reference numeral 4 represents a back glass substrate disposed opposite to the front glass substrate 1, with an electric discharge space S formed therebetween. A plurality of column electrodes D are provided on the inner surface of the back glass substrate 4 and arranged in R direction, in a manner such that the column electrodes D are orthogonal to the row electrode pairs (X, Y). In practice, the plurality of column electrodes D are disposed in the same identical plane, parallelly spaced apart from one another at a predetermined interval.

Further, a plurality of stripe-like partition walls 5 extending in the column direction (R direction) are also arranged on the inner surface of the back glass substrate 4, with one partition wall disposed between every two adjacent column electrodes D. By virtue of the partition walls 5, the electric discharge space S is divided into a plurality of small spaces S, forming a plurality of discharge cells (smallest units of the display panel). Moreover, a plurality of fluorescent layers 6 extending in the column direction (R direction) are provided to cover exposed portions of the inner surface of the back glass substrate 4 as well as the side surfaces of each partition wall 5. In detail, the fluorescent layers 6 include R (Red), G (Green), B (Blue) layers arranged repeatedly in the display line direction L, with each color layer located between every two adjacent partition walls 5.

Subsequently, the front glass substrate 1 (carrying the row electrodes X, Y, the dielectric layer 2 and the protection layer 3) and the back glass substrate 4 (carrying the column electrodes D, the partition walls 5 and the fluorescent layers 6) are bonded together by means of a seat layer (not shown), thereby forming a plurality of discharge spaces S between the two glass substrates, as shown in FIG. 5.

Then, the discharge spaces S are vacuumized, and a mixed gas (such as Ne—Xe gas or He—Xe gas) capable of producing an ultraviolet light during electric discharge is sealed into the vacuum spaces. Afterwards, a plurality of module elements such as driver IC and the like are attached, thereby forming an AC-type plasma display panel (PDP).

FIG. 5 is a cross sectional view showing a cross section of the AC-type plasma display panel (PDP), taken along a line coincident with a row electrode pair (X, Y). As shown in FIG. 5, the partition walls 5 provided on the inner surface of the back glass substrate 4 are in contact with the protection layer 3, serving as spacers between the front glass substrate 1 and the back glass substrate 4, and defining a plurality of elongated spaces each containing a column electrode D. In this way, the plurality of column electrodes D as welt as the partition walls 5 are arranged to be orthogonal to the row electrode pairs (X, Y), forming a plurality of discharge cells C each serving as a unit luminescent area.

The operation of the AC-type plasma display panel (PDP) may be described as follows. At first, by virtue of address operation, electric discharges are effected in selected discharge cells C between the row electrode pairs (X, Y) on one hand and the column electrodes D on the other. As a result, lighting cells (cells having wall charges formed in the dielectric layer 2) and non-lighting cells (cells not having wall charges formed in the dielectric layer 2) are distributed on the panel, corresponding to an image being displayed on the display panel. After the address operation, discharge sustaining pulses are applied alternatively to the row electrode pairs (X, Y), effecting surface discharges in the lighting cells whenever the discharge sustaining pulses are applied. Thus, by virtue of the surface discharges in the lighting cells, ultraviolet lights are generated, rendering the R, G, B color fluorescent layers to emit corresponding color lights, thereby forming a color image on the display panel.

However, the above-described conventional AC-type plasma display panel has been found to have the following problem. Namely, a step of forming the plurality of partition walls is the most difficult step in the whole process for manufacturing the display panel. A representative method for forming the partition walls requires that an amount of glass paste containing a white pigment is applied to the inner surface of the back glass substrate, followed by a drying treatment so as to form a glass layer having a predetermined thickness. Afterwards, the glass layer is subjected to a sand blasting treatment with the use of a mask having a predetermined pattern, thereby selectively cutting and thus removing predetermined portions of the glass layer. Subsequently, a sintering treatment is carried out at a predetermined temperature, thereby forming a plurality of stripe-like partition walls 5 each having a rectangular or trapezoidal cross section.

Subsequently, an amount of fluorescent paste is applied so as to cover the side surfaces of the partition walls 5, the column electrodes D, as well as the exposed portions of the inner surface of the back glass substrate 4, followed by a sintering treatment for sintering the applied fluorescent paste, thereby forming a plurality of fluorescent layers 6 shown in FIG. 4 and FIG. 5.

With the above-described conventional plasma display panel, the formation of the fluorescent layer 6 on the side surfaces of the partition walls 5, the column electrodes D, as well as the exposed portions of the inner surface of the back glass substrate 4, can enable the fluorescent layers to have a sufficient total area and thus render the display panel to produce a sufficient brightness. However, as shown in FIG. 5, when the fluorescent layers 6 are formed in the above-described manner, each fluorescent layer's portions a near the tops of adjacent partition walls 5 are thinner than other portions of the fluorescent layer 6, resulting in a problem that it is difficult for the plasma display panel to produce a sufficient brightness.

SUMMARY OF THE INVENTION

It is an object of the present invention to provide an improved plasma display panel and a method for manufacturing the same, in which each fluorescent layer's portions near the tops of adjacent partition walls have a sufficient thickness, enabling the fluorescent layer within each discharge cell to have a substantially uniform thickness, thereby enabling the plasma display panel to produce a sufficient brightness.

According to the present invention, there is provided a plasma display panel which comprises a front substrate plate; a back substrate plate arranged opposite to the front substrate plate with an electric discharge space formed therebetween; a plurality of partition walls dividing the discharge space into a plurality of discharge cells; and a plurality of fluorescent layers each covering the bottom and side surfaces of each discharge cell. In particular, each of the partition walls has a T-shaped cross section.

In one aspect of the present invention, each partition wall includes a top portion having a dark or black color, and a main body portion having a light or white color.

In another aspect of the present invention, the width of the top portion is larger than the width of the main body portion, so that the top portion is protruding from the main body portion on both sides thereof.

In a further aspect of the present invention, each fluorescent layer's portions located close to the top portions of adjacent partition walls have a thickness equal to the protruding extent of each top portion.

Further, according to the present invention, there is provided a method of manufacturing a plasma display panel which comprises: a front substrate plate; a back substrate plate arranged opposite to the front substrate plate, with an electric discharge space formed therebetween; a plurality of partition walls dividing the discharge space into a plurality of discharge cells; and a plurality of fluorescent layers each covering the bottom and side surfaces of each discharge cell. The method comprises the steps of: applying, to the inner surface of the back substrate plate, a first glass paste containing a predetermined amount of a binder and then a second glass paste containing a larger amount of a binder than the first glass paste, so as to form a first glass paste layer and a second glass paste layer which together will subsequently be formed into a plurality of partition walls; treating the second glass paste layer so as to form a mask corresponding to a pattern of the partition walls on the first glass paste layer, thus partially exposing the first glass paste layer; performing a sand blasting treatment on the exposed portions of the first glass paste layer, so as to selectively cut and thus partially remove the first glass paste layer; and sintering the first and second glass paste layers to form the plurality of partition walls.

In a still further aspect of the present invention, subsequent to the formation of the partition walls, internal spaces between the partition walls are filled with a fluorescent paste, followed by sintering the fluorescent paste, thereby forming a fluorescent layer in each of the internal spaces.

The above objects and features of the present invention will become better understood from the following description with reference to the accompanying drawings.

DETAILED DESCRIPTION OF THE PREFERRED EMBODIMENTS

Figure 1:
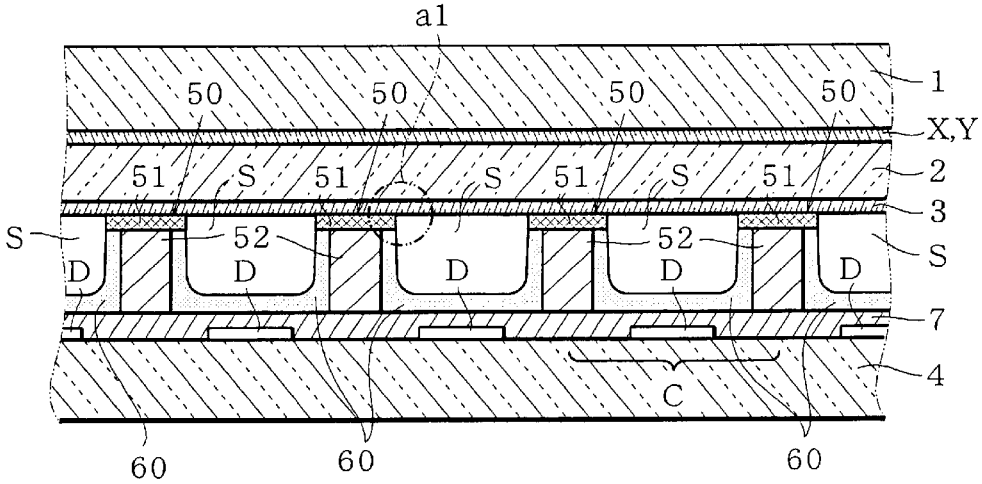
FIG. 1 is a cross sectional view showing a plasma display panel formed according to an embodiment of the present invention.

An embodiment of the present invention will be described below with reference to the accompanying drawings (elements similar to those in the above-described prior art will be represented by the same reference numerals).

FIG. 1 is a cross sectional view of a plasma display panel formed according to the present invention, which is taken by virtually cutting along a row electrode pair (X, Y) of the panel, with the cutting direction being perpendicular to the front and back substrate plates.

Referring to FIG. 1, the plasma display panel of the present invention has a front glass substrate 1 whose front surface serves as a display surface. A plurality of row electrode pairs (X, Y) extending in row direction (L direction, i.e., display line direction) are provided on the inner surface of the front glass substrate 1. A dielectric layer 2 is also formed on the inner surface of the front glass substrate 1 to cover up the row electrode pairs (X, Y). Moreover, a protection layer 3 consisting of MgO is formed to cover the dielectric layer 2.

Similar to the above-described conventional plasma display panel, one row electrode X of each row electrode pair (X, Y) includes i) a belt-like transparent electrode Xa extending in row direction and consisting of a transparent electrically conductive film such as ITO, and ii) a bus electrode Xb similarly extending in the row direction and connected with the edge portions of the transparent electrode Xa. Similarly, the other row electrode Y of each row electrode pair (X, Y) includes i) a belt-like transparent electrode Ya extending in the row direction and consisting of a transparent electrically conductive film such as ITO, and ii) a bus electrode Yb similarly extending in the row direction and connected with the edge portions of the transparent electrode Ya. In this way, a plurality of the row electrodes X and a plurality of the row electrodes Y are arranged alternatively in column direction (R direction), with each row electrode pair (X, Y) forming an electric discharge gap therebetween.

On the other hand, the plasma display panel has a back glass substrate 4 disposed opposite to the front glass substrate 1, with an electric discharge space S formed therebetween. A plurality of column electrodes D are provided on the inner surface of the back glass substrate 4 and arranged in R direction, in a manner such that the column electrodes D are orthogonal to the row electrode pairs (X, Y). In practice, the plurality of column electrodes D are disposed in the same identical plane, parallelly spaced apart from one another at a predetermined interval.

Further, a dielectric layer 7 is formed on the inner surface of the back glass substrate 4, in a manner such that the column electrodes D are covered by the dielectric layer 7. Then, a plurality of partition walls 50 are formed on the dielectric layer 7 to divide the discharge space S into several smaller spaces S, forming a plurality of discharge cells (smallest luminescent units of the display panel). Moreover, a plurality of fluorescent layers 60 extending in the column direction (R direction) are provided to cover the dielectric layer 7 and both side surfaces of each partition wall 50. In detail, the plurality of fluorescent layers 60 include R (Red), G (Green), B (Blue) color layers arranged repeatedly in the display line direction L, with each color layer located between every two adjacent partition walls 5.

Here, each partition wall 50 includes a dark or black top portion 51 and a light or white main body portion 52, forming a T-shaped cross section as shown in FIG. 1, with the top portion 51 protruding on both sides of the main body portion 52. In this way, each fluorescent layer 60 may be so formed that its portions in contact with the dark black to portions 51 of adjacent two partition walls 50 are allowed to have a thickness corresponding (equal) to the protruding width of each top portion 51, thereby ensuring the brightness of each discharge cell and thus ensuring a sufficient total brightness for the plasma display panel.

Here, since the top portion 51 of each partition wall 50 is made of a material having a dark or black color, each top portion 51 can serve as a black matrix, thereby making it sure to prevent an undesired reflection of any external lights and thus improving the contrast of the display panel. Further, since the main body portion 52 of each partition wall 50 is made of a material having a light or white color, all the displaying lights from the fluorescent layer 60 can be reflected by the surfaces of the main body portions 52 of the partition walls 50, thereby improving the utilization efficiency of the displaying lights.

A method of manufacturing the plasma display panel of the present invention may be described below with reference to FIG. 2 and FIG. 3.

Figure 2A:
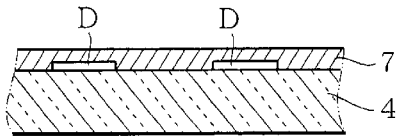
FIGS. 2A–2F are explanatory views showing several steps involved in a process for manufacturing the plasma display panel according to the embodiment of the present invention.

Referring to FIG. 2A, at first, a plurality of column electrodes D are formed on the inner surface of the back glass substrate 4 in accordance with a predetermined pattern. Then, the dielectric layer 7 is formed to cover the column electrodes D so as to protect the column electrodes. Here, the column electrodes D are formed by vapor depositing an aluminium or an aluminium alloy on the inner surface of the back glass substrate 4, followed by a patterning treatment using a photolithography method. Then, the dielectric layer 7 is formed by applying a glass paste containing a white color pigment (such as titan oxide), a dark coloring material or a black coloring material, so as to cover up the column electrodes D and the inner surface of the back glass substrate 4.

Figure 2B:
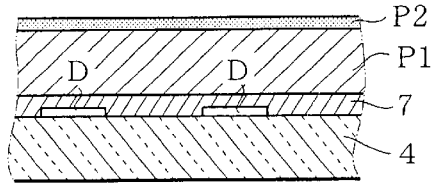

Subsequently, as shown in FIG. 2B, a first low melting point glass paste P1 containing a white color pigment and a non-photosensitive resin (serving as a binder) is applied to the upper surface of the dielectric layer 7 (serving as a protection layer for protecting the column electrodes D), to form a first glass paste layer having a thickness of 100–200 $\mu$m. Then, a second low melting point glass paste P2 containing a dark or black pigment and a non-photosensitive resin (serving as a binder) is applied to the upper surface of the first glass paste layer, to form a second glass paste layer having a thickness of 10–40 $\mu$m. In this way, two glass paste layers are formed with the lower layer being thinker than the upper layer.

At this time, the first low melting point glass paste P1 contains a first glass powder, a binder (non-photosensitive resin), an organic solvent, a white color pigment and the like. A mixing ratio of the first glass powder to the binder is 9:1. On the other hand, the second low melting point glass paste P2 contains a second glass powder, a binder (photosensitive resin), an organic solvent, and a dark or black color pigment. A mixing ratio of the second glass powder to the binder is 1:1. Specifically, the thermal expansion coefficient of the first low melting point glass paste P1 is $70\times10^{-8}/°$ C. the thermal expansion coefficient of the second low melting point glass paste P2 is $85\times10^{-8}/°$ C. Each of the glass pastes P1 and P2 is applied to the above surfaces by using a screen printing method.

Here, the first low melting point glass paste P1 contains a white color pigment, so that the side surfaces of the partition walls 50 have a white color, thereby permitting all the displaying lights from the fluorescent layers 60 to be reflected sufficiently by the side surfaces of the partition walls 50, and thus improving the utilization efficiency of the displaying lights. On the other hand, it is also allowable that the first low melting point glass paste does not contain any pigment, thereby making the main body portions 52 of the partition walls 50 to be transparent.

Further, the first low melting point glass paste P2 contains a dark or black color pigment, so that the top portions 51 of the partition walls 50 are in a dark or a black color, thereby preventing an undesired reflection of external lights and thus improving the contrast of the display panel.

Figure 2C:
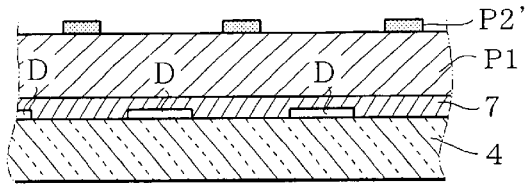
Figure 2D:
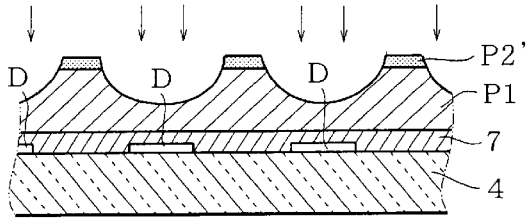
Figure 2E:
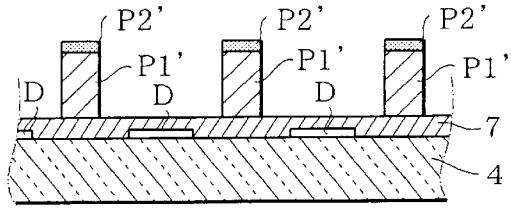
Figure 2F:
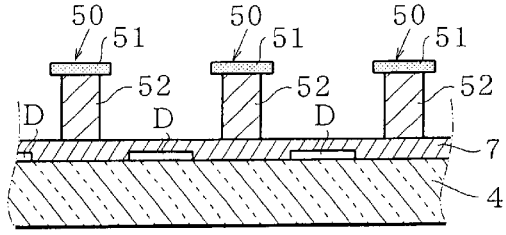

Then, as shown in FIG. 2C, an exposure treatment and development treatment are carried out to treat the second glass paste layer P2, thereby forming a plurality of stripe-like glass paste layers P2'. Subsequently, as shown in FIG. 2D, the plurality of stripe-like glass paste layers P2' (having a durability against the sand blasting) are used as a mask to perform a sand blasting treatment to partially cut off the first glass paste player P1. In practice, such a sand blasting treatment is continued until the upper surface of the dielectric layer 7 becomes exposed except those corresponding to the plurality of stripe-like glass paste layers P2', as shown in FIG. 2E.

In this way, a plurality of stripe-like glass paste layers P1' are thus formed, with each being positioned between the dielectric layer 7 and a stripe-like glass player P2'. Then, the glass paste layers P1' and P2' are subjected to a sintering treatment at a temperature of 500–600° C., thereby forming a plurality of partition walls 50, each including a top portion 51 (formed by the glass paste layer P2') having a dark or black color and a main body portion 52 (formed by the glass paste layer P1') having a white color. At this time, since the thermal expansion coefficient and the binder content of the glass paste layers P1' are different from those of the glass paste layers P2', the top portions 51 have a different width from that of the main body portions 52, with each top portion 51 being larger in width than that of a corresponding main body portion 52, thereby rendering each partition wall 50 to have a T-shaped cross section.

Figure 3A:
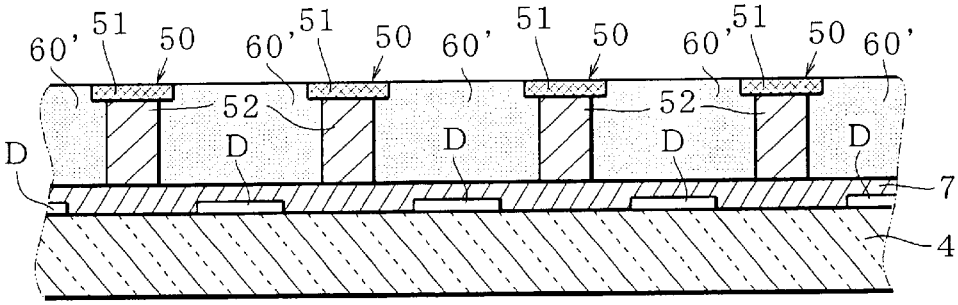
FIGS. 3A–3B are explanatory views showing several further steps involved in the process for manufacturing the plasma display panel according to the embodiment of the present invention.
Figure 3B:
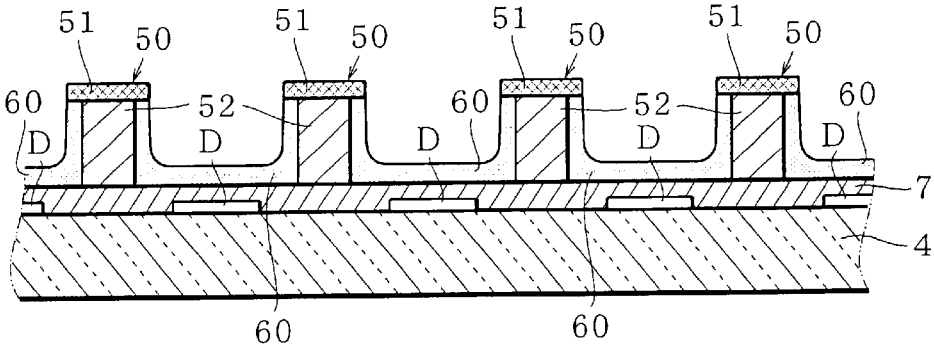
Figure 4:
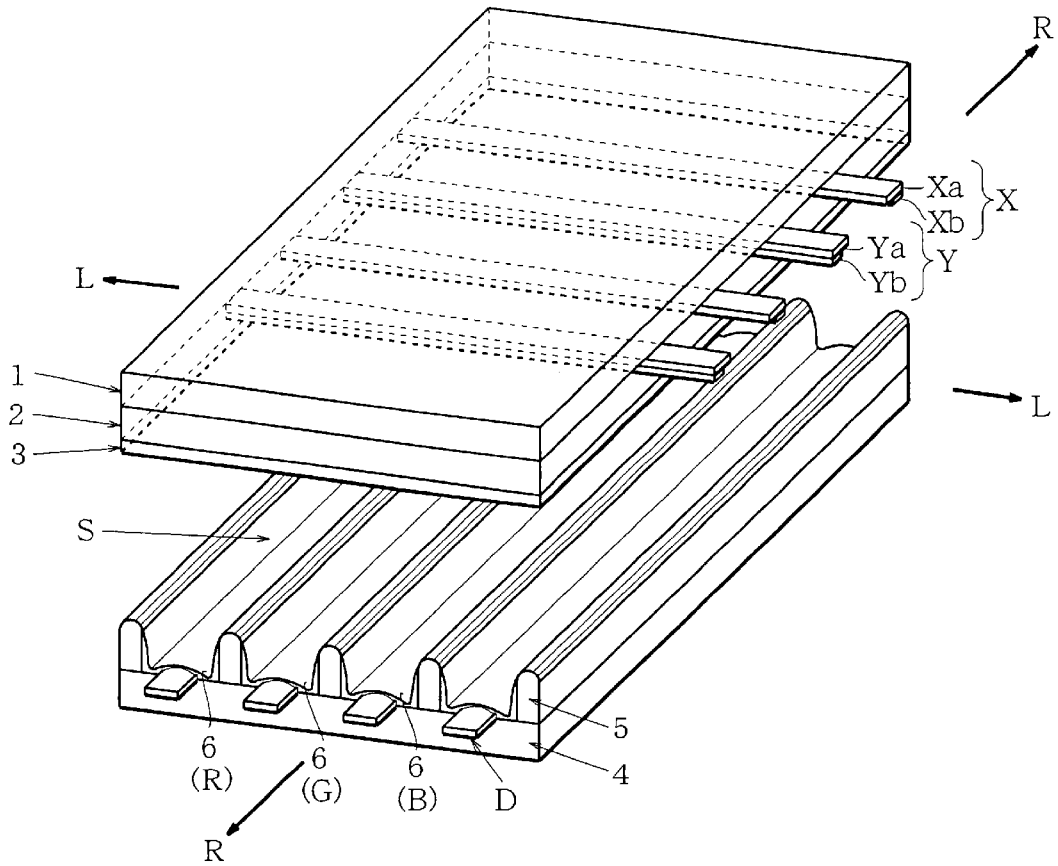
FIG.4 PRIOR ART
FIG. 4 is a perspective view showing the structure of a conventional plasma display panel.
Figure 5:
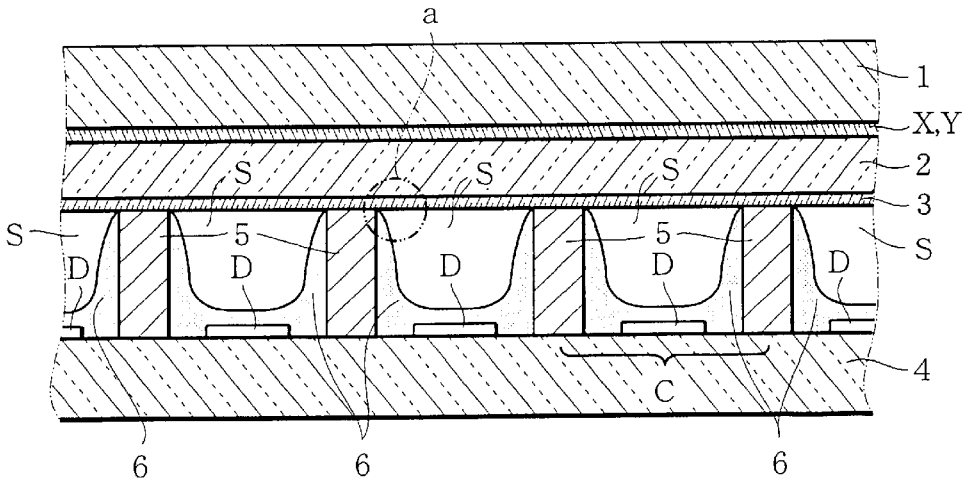
FIG.5 PRIOR ART
FIG. 5 is a cross sectional view showing the conventional plasma display panel.

A step of forming a plurality of fluorescent layers 60 may be described below with reference to FIGS. 3A and 3B. At first, as shown in FIG. 3A, a plurality of spaces formed between the plurality of partition walls 50 are filled with a fluorescent paste 60'. At this time, it is important that the spaces right under the top portions 51 be sufficiently filled by the fluorescent paste 60'.

Afterwards, the fluorescent paste 60' located between the partition walls 50 are subjected to a sintering treatment, thereby forming a plurality of fluorescent layers 60, covering the side surfaces of all partition walls 50 and the exposed portions of the dielectric layer 7. At this time, as shown in FIG. 3B, each fluorescent layer 60 has a uniform thickness, with its horizontal portion (in contact with an exposed portion of the dielectric layer 7) having the same thickness as that of its vertical portions (in contact with the side surfaces of partition walls 50). Specifically, the fluorescent layer's portions near the top portions 51 of adjacent partition walls 50 has a thickness corresponding (equal) to a horizontally protruding amount of each top portion 51 (protruding from a main body portion 52).

On the other hand, the formation of the front glass substrate 1 may be completed using a conventional process. Namely, referring to FIG. 1, a thin film such as ITO film is formed on the inner surface of the front glass substrate 1, by virtue of sputterring. Then, a photolithography treatment is conducted to obtain a patterning effect, thereby forming a plurality of transparent electrodes (Xa, Ya). Subsequently, an alloy layer of Cr—Cu—Cr is formed on the inner surface of the front glass substrate 1, covering the transparent electrodes (Xa, Ya), by virtue of vapor deposition or sputterring treatment. Then, a photolithography treatment is performed to obtain a patterning effect, thereby forming a plurality of bus electrodes (Xb, Yb). Afterwards, a low melting point glass paste is applied to the inner surface of the front glass substrate 1 to cover up the row electrode pairs (X, Y) consisting of the transparent electrodes (Xa, Ya) and the bus electrodes (Xb, Yb), thereby forming a transparent dielectric layer 2. Subsequently, MgO is depositted on the transparent dielectric layer 2 by virtue of EB vapor deposition or a vacuum vapor deposition, thereby forming a protection layer 3.

Finally, the front glass substrate 1 (carrying the row electrode pairs X, Y, the transparent dielectric layer 2 and the protection layer 3) is combined with the back glass substrate 4 (carrying the column electrodes D, the dielectric layer 7, the partition walls 50 and the fluorescent layers 60), by means of a seal layer (not shown), thereby forming a plurality of discharge spaces S. Then, the discharge spaces S are vacuumized, and a mixed gas (such as Ne—Xe gas or He—Xe gas) capable of producing an ultraviolet light during electric discharge is sealed into the vacuum spaces, thereby forming an AC-type plasma display panel (PDP) of the present invention.

In this way, since the plasma display panel formed according to the present invention is so formed that fluorescent layer's portions near the top of each partition wall have a sufficient thickness and this enables the fluorescent layer within each discharge cell to have a substantially uniform thickness everywhere, it is sure to enable the plasma display panel to provide a sufficient brightness.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. A plasma display panel comprising:

a front substrate plate;

a back substrate plate arranged opposite to the front substrate plate, with an electric discharge space formed therebetween;

a plurality of partition walls dividing the discharge space into a plurality of discharge cells; and a plurality of fluorescent layers each covering the bottom and side surfaces of each discharge cell;

wherein each of the partition walls has a T-shaped cross section.

2. A plasma display panel according to claim 1, wherein each partition wall includes a top portion having a dark or black color, and a main body portion having a light or white color.

3. A plasma display panel according to claim 2, wherein the width of the top portion is larger than the width of the main body portion, so that the top portion is protruding from the main body portion on both sides thereof.

4. A plasma display panel according to claim 3, wherein each fluorescent layer's portions located close to the top portions of adjacent partition walls have a thickness equal to the protruding extent of each top portion.

5. A plasma display panel according to claim 2, wherein each partition wall includes a top portion, and wherein each fluorescent layer's portions located close to the top portions of adjacent partition walls have a thickness equal to the protruding extent of each top portion.

* * * * *